US005941087A

United States Patent [19]

Lee

[11] Patent Number: 5,941,087

[45] Date of Patent: Aug. 24, 1999

[54] REFRIGERATOR HAVING AN APPARATUS FOR PREVENTING AN AIR FROM FLOWING INTO THE REFRIGERATOR

[75] Inventor: Chang-Hoon Lee, Seoul, Rep. of Korea

[73] Assignee: Daewoo Electronics Co., Ltd., Seoul, Rep. of Korea

[21] Appl. No.: 09/121,304

[22] Filed: Jul. 23, 1998

[30] Foreign Application Priority Data

Jul. 31, 1997 [KR] Rep. of Korea ..... 94-36775

[51] Int. Cl.[6] ..... A47F 3/04; F25D 17/04

[52] U.S. Cl. ..... 62/256; 62/408; 62/407; 62/186

[58] Field of Search ..... 62/407, 408, 186, 62/256

[56] References Cited

U.S. PATENT DOCUMENTS

| | | | |
|---|---|---|---|
| 2,263,456 | 11/1941 | Darcy | 62/89 |
| 4,299,092 | 11/1981 | Ibrahim | 62/265 |
| 4,379,391 | 4/1983 | Rhee | 62/408 |
| 5,191,774 | 3/1993 | Park | 62/408 |
| 5,826,441 | 10/1998 | Oh | 62/256 |

*Primary Examiner*—Henry Bennett
*Assistant Examiner*—Melvin Jones
*Attorney, Agent, or Firm*—Pillsbury Madison & Sutro LLP

[57] ABSTRACT

A refrigerator having an apparatus for preventing an air from flowing into the refrigerator. The refrigerator has a refrigerator body, a compartment for separating the refrigerator body into freezing and refrigerating chambers and having a plurality of draining holes at a front end portion of an upper surface thereof and having a first plurality of holes at a front end portion of a lower surface thereof for flowing a cooled air in the freezing chamber into the refrigerating chamber, an apparatus for allowing the cooled air in the freezing chamber to flow into the refrigerating chamber by opening the first plurality of holes while a door of the refrigerating chamber is being opened thereby forming an air curtain and for removing the air curtain by closing the first plurality of holes while the door of the refrigerating chamber is being closed, a blower arranged at a rear portion of the freezing chamber for blowing the cooled air so as to circulate the cooled air in the freezing chamber into the refrigerating chamber, and a switch for transmitting an electric power to the blower thereby operating the blower while the door of the refrigerating chamber is being opened, and for closing the electric power transmitted to the blower thereby stopping the operation of the blower while the door of the refrigerating chamber is being closed. The apparatus for preventing the air from flowing into the refrigerator effectively prevents the air from flowing into the refrigerator by a simple structure.

11 Claims, 4 Drawing Sheets

REFRIGERATOR HAVING AN APPARATUS FOR PREVENTING AN AIR FROM FLOWING INTO THE REFRIGERATOR

BACKGROUND OF THE INVENTION

1. Field of the Invention

The present invention relates to a refrigerator, and more particularly to a refrigerator having an apparatus for preventing an air from flowing into the refrigerator.

2. Description of the Prior Art

A refrigerator is an apparatus for freshly storing foodstuffs in a lower temperature state. Generally, the refrigerator has a compressor for circulating a refrigerant gas by a compression, a condenser for condensing the refrigerant gas so as to make a liquefied refrigerant, and an evaporator for evaporating the liquefied refrigerant gas so as to generate a cooled air. The refrigerator is divided into a refrigerating chamber for storing the items to be stored at a lower temperature such as subsidiary articles and a freezing chamber for storing the items to be frozen such as meats. The cooled air generated by the evaporator flows into the refrigerator and freezing chamber by a blower.

While the refrigerator door is opened and closed, the air flows into the refrigerator so that the inner temperature of the refrigerator is decreased. Accordingly, the apparatus is provided for preventing the air from flowing into the refrigerator.

The apparatus for preventing the air from flowing into the refrigerator is disclosed in a U.S. Pat. No. 4,379,391 (issued to Jae W. Rhee).

FIG. 1 illustrates the refrigerator having an apparatus 130 for preventing the air from flowing into the refrigerator. As illustrated in FIG. 1, the refrigerator 100 has a body 110, freezing and refrigerating chambers 150 and 160 divided by a compartment 140 in the body 110, a door 120 for opening/closing an opening 115 formed at a front side of the body 110, and the apparatus 130 for preventing the air from flowing into the refrigerator 100.

Additionally, the apparatus 130 for preventing the air from flowing into the refrigerator has a blower 132 for blowing the cooled air, a jetting port 136 connected to the blower 132 by a blowing conduit 134 for jetting the cooled air in an upper direction thereof, a sucking port 133 connected to the blower 132 by a conduit 139 for sucking the cooled air jetted from the sucking port 136, and first and second switches 170 and 180 connected to the blower 132 for driving the blower 132 while the door 120 is being opened. The blower 132 is mounted at an inner-lower portion of the body 110 of the refrigerator 100, and supplies the cooled air to the jetting port 136 through the blowing conduit 134. The jetting port 136 has a semicircular shape and is formed at a lower portion of the opening 115 of the refrigerator 100, and is formed at one side thereof with a jetting nozzle 135.

The jetting port 136 upwardly jetties the cooled air supplied thereto through the blowing conduit 134 for forming an air curtain 190 at the opening 115 of the refrigerator 100.

The sucking port 133 has a semicircular shape, and is formed at one side thereof with a sucking nozzle 137. The cooled air sucked through the sucking nozzle 137 returns to the blower 132 through the conduit 139.

The first switch 170 is attached at an inner side of the refrigerator door 120 and is connected to the blower 132 by an electric wire 174. When the user grips a handle 172 of the refrigerator door 120, the first switch is "On", and when the user releases the handle of the refrigerator door 120, the first switch is "Off". Accordingly, when the user grips the handle 172 of the refrigerator 100, the blower 132 is operated. And, when the user releases the handle 172 of the refrigerator 100, the operation of the blower 132 is stopped.

The second switch 180 is attached to a right side of the opening 115 of the refrigerator 100, and is connected to the blower 132 by the electric wire 176. When the user grips a handle 172 of the refrigerator door 120, the second switch is "On", and when the user releases the handle of the refrigerator door 120, the second switch is "Off". Accordingly, when the user grips the handle 172 of the refrigerator 100, the blower 132 is operated. And, when the user releases the handle 172 of the refrigerator 100, the operation of the blower 132 is stopped.

When the user grips the handle 172 of the door 120 for opening the refrigerator door 120, the first switch is "On" and the blower begins to operate. The cooled air begins to be supplied to the jetting port 136 through the blowing conduit 134 by the operation of the blower 132, the cooled air beins to be sucked into the sucking port 133.

When the refrigerator door 120 is opened, the cooled air is rapidly jetted in the upward direction through the jetting nozzle of the jetting port 135, and the cooled air is sucked into the suction port 133. Accordingly, the air curtain 190 is formed at the opening of the refrigerator 100, and the air is prevented from flowing into the refrigerator 100. T he cooled air returns to the blower 132 through the sucking port 133. When the refrigerator door 120 is opened, the second switch 180 is "On". Accordingly, even when the user releases the handle 170 of the refrigerator door 120, the blower is continuously operated.

When the refrigerator door 120 is closed and the user grips the handle 172, the first switch 170 is "On" again and the blower 132 is continuously operated so that the air curtain is continuously formed.

When the user finally releases the handle 172 of the refrigerator door 120, the first switch is "Off" so that the air curtain is removed.

However, since the structure of the apparatus is complicated, it takes a long time to assemble the apparatus, so the manufacturing cost thereof is increased.

SUMMARY OF THE INVENTION

Accordingly, the present invention has been made to solve the foregoing problem, the object is to provide the apparatus for effectively preventing the air from flowing into the refrigerator by a simple structure.

In order to achieve the above object, the refrigerator comprises:

a refrigerator body;

a compartment for separating the refrigerator body into freezing and refrigerating chambers having a plurality of draining holes at a front end portion of an upper surface thereof and having a first plurality of holes at a front end portion of a lower surface thereof for communicating with the plurality of draining holes thereby flowing a cooled air in the freezing chamber into the refrigerating chamber;

a means for allowing the cooled air in the freezing chamber to flow into the refrigerating chamber by opening the first plurality of holes while a door of the refrigerating chamber is being opened thereby forming an air curtain and for removing the air curtain by closing the first plurality of holes while the door of the refrigerating chamber is being closed;

a blower arranged at a rear portion of the freezing chamber for blowing the cooled air so as to circulate the cooled air in the freezing chamber into the refrigerating chamber; and a switch for transmitting an electric power to the blower thereby operating the blower while the door of the refrigerating chamber is being opened, and for closing the electric power transmitted to the blower thereby stopping the blower while the door of the refrigerating chamber is being closed.

According to the present invention, the means includes a first lever installed on an inner-lower surface of the compartment in a vertical direction with respect to a front end surface of the compartment so as to linearly reciprocate according to an opening/closing of the door of the refrigerating chamber, a second lever installed in a vertical direction with respect to the first lever, for linearly reciprocating thereby opening/closing the first plurality of holes, and a circular gear rotatably installed at an inner portion of a vertical portion formed by the first and second levers, the circular gear being simultaneously engaged with the first and second levers so that the circular gear transmits the linearly reciprocating of the first lever to the second lever thereby allowing the second lever to reciprocate. The first lever has a first end portion in which a projection is protrudingly formed for make contact with a door of the refrigerating chamber, and has a second end portion opposite to the first end portion to which a compressed spring is connected. The compressed spring is elastically supported by a supporting bracket spaced apart from a second end portion of the first lever by a predetermined distance in a rear direction. The first lever is formed at one side thereof with a rack gear engaged with the circular gear. A guide member is fixed to an inner lower surface of the compartment for guiding the first lever while the first lever is being reciprocated. The circular gear is rotatably fixed to a central shaft upwardly and protrudingly formed from the inner-lower surface of the compartment. The second lever is formed at a body thereof with a second plurality of holes, and the second plurality of holes thereof communicates with the first plurality of holes of the compartment while the second lever is being reciprocated. A compressed spring is disposed between a first end portion of the second lever and a supporting bracket formed at a rear portion of the first end portion of the second lever thereby elastically exerting the second lever. The second lever is formed at one side thereof with a rack gear engaged with the circular gear. A guide member is fixed to an inner-lower surface of the compartment for guiding the second lever while the second lever is being reciprocated. The switch is of an "On/Off" type.

The apparatus for preventing the air from flowing into the refrigerator effectively prevents the air from flowing into the refrigerator by a simple structure.

BRIEF DESCRIPTION OF THE DRAWINGS

The above object and advantages of the present invention will become more apparent by describing in detail preferred embodiments thereof with reference to the attached drawings, in which.

DETAILED DESCRIPTION OF THE INVENTION

Hereinafter, a preferred embodiment of the present invention will be explained in more detail with reference to the accompanying drawings.

Figure 1:
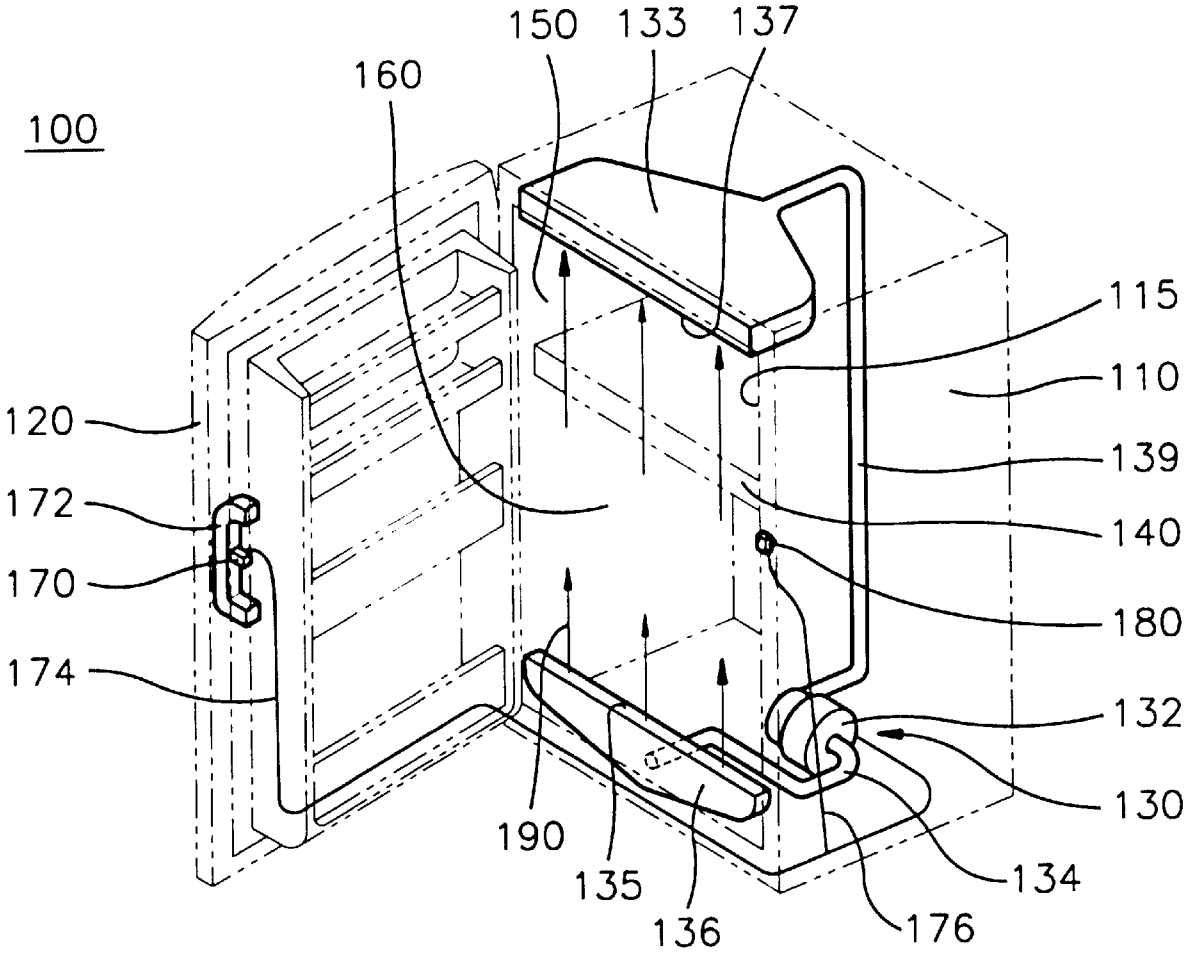
FIG. 1 (PRIOR ART)
FIG. 1 is a perspective view showing a conventional apparatus for preventing the air from flowing into the refrigerator.
Figure 2:
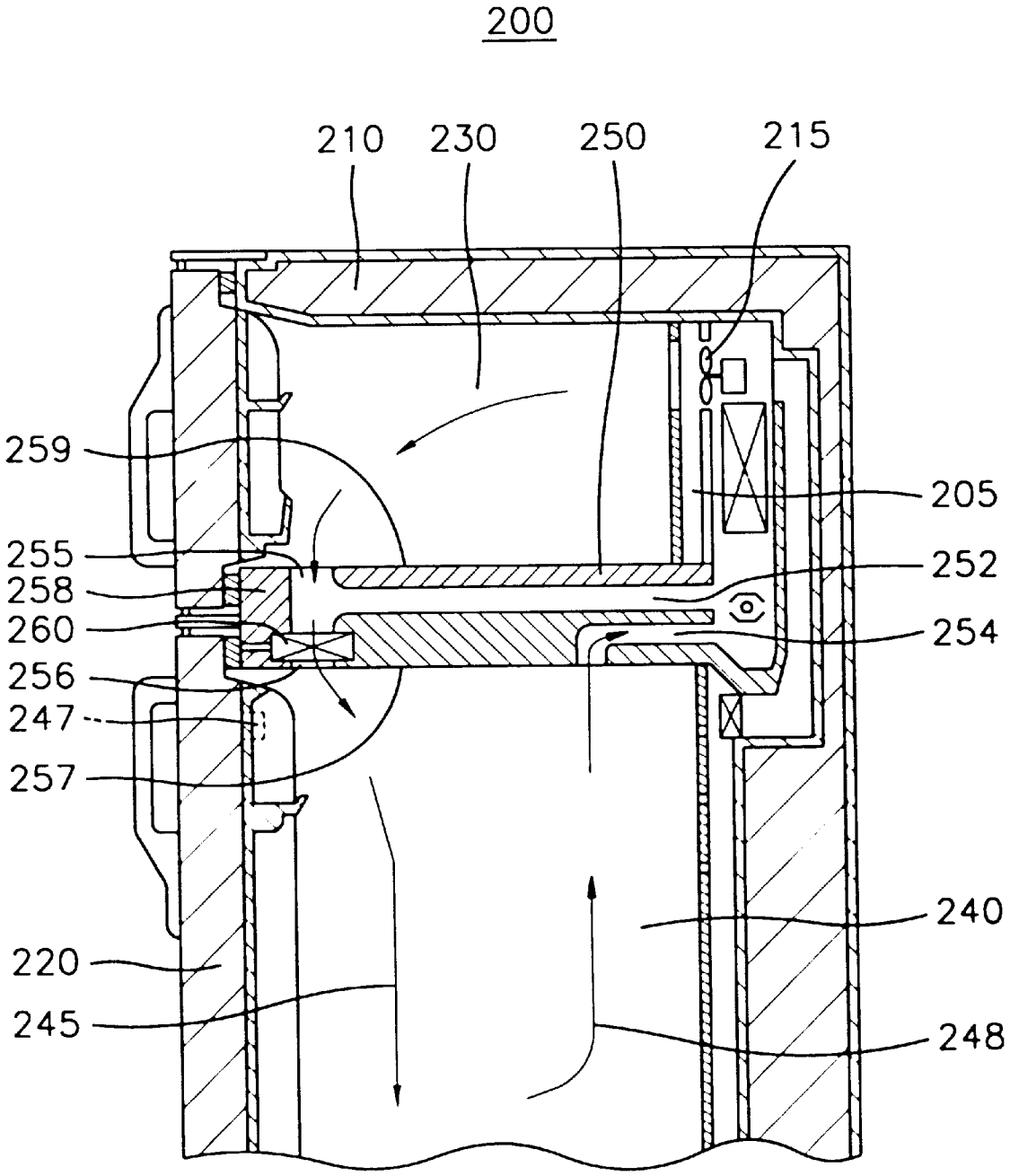
FIG. 2 is a sectional view showing the refrigerator having the apparatus for preventing the air from flowing into the refrigerator according to one embodiment of the present invention.

FIG. 2 is a sectional view showing the refrigerator having the apparatus for preventing the air from flowing into the refrigerator according to one embodiment of the present invention. As illustrated in FIG. 2, the refrigerator 200 has a refrigerator body 210, a compartment 250 for separating the refrigerator body 210 into freezing and refrigerating chambers 230 and 240, and having a first plurality of holes 256 at a front end portion 258 of a lower surface 257 thereof for flowing a cooled air in the freezing chamber 230 into the refrigerating chamber 240, a first apparatus 260 for flowing the cooled air in the freezing chamber 230 into the refrigerating chamber 240 by opening the first plurality of holes 256 while a door 220 of the refrigerating chamber 240 is being opened thereby forming an air curtain 245, and for removing the air curtain 245 by closing the first plurality of holes 256 while the door 220 of the refrigerating chamber 240 is being closed, a blower 215 arranged at a rear portion of the freezing chamber 230 for blowing the cooled air so as to circulate the cooled air in the freezing chamber 230 into the refrigerating chamber 240, and a switch 247 for transmitting an electric power to the blower 215 thereby operating the blower 215 while the door 220 of the refrigerating chamber 240 is being opened, for closing the electric power transmitted to the blower 215 so as to stop the operation of the blower 215 while the door 220 of the refrigerating chamber 240 is being closed.

The compartment 250 has a tetrahedron shape, and is formed at an inner-upper portion thereof with a freezing chamber returning duct 252 for returning the cooled air in the freezing chamber 230 into a cooling room 205, and is formed at a lower portion of the freezing chamber returning duct 252 with a refrigerating chamber returning duct 254 for returning the cooled air in the refrigerating chamber 240 into the cooling room 205.

The compartment 250 is formed at a front end portion 258 of an upper surface 259 thereof with a plurality of draining holes 255. The cooled air in the freezing chamber 230 flows into the freezing chamber returning duct 252 through the plurality of draining holes 255.

The compartment 250 is formed at a front end portion 258 of a lower surface 257 thereof with a first plurality of holes 256. The cooled air in the freezing chamber 230 flows into the refrigerating chamber 240 through the first plurality of holes 256.

Figure 3:
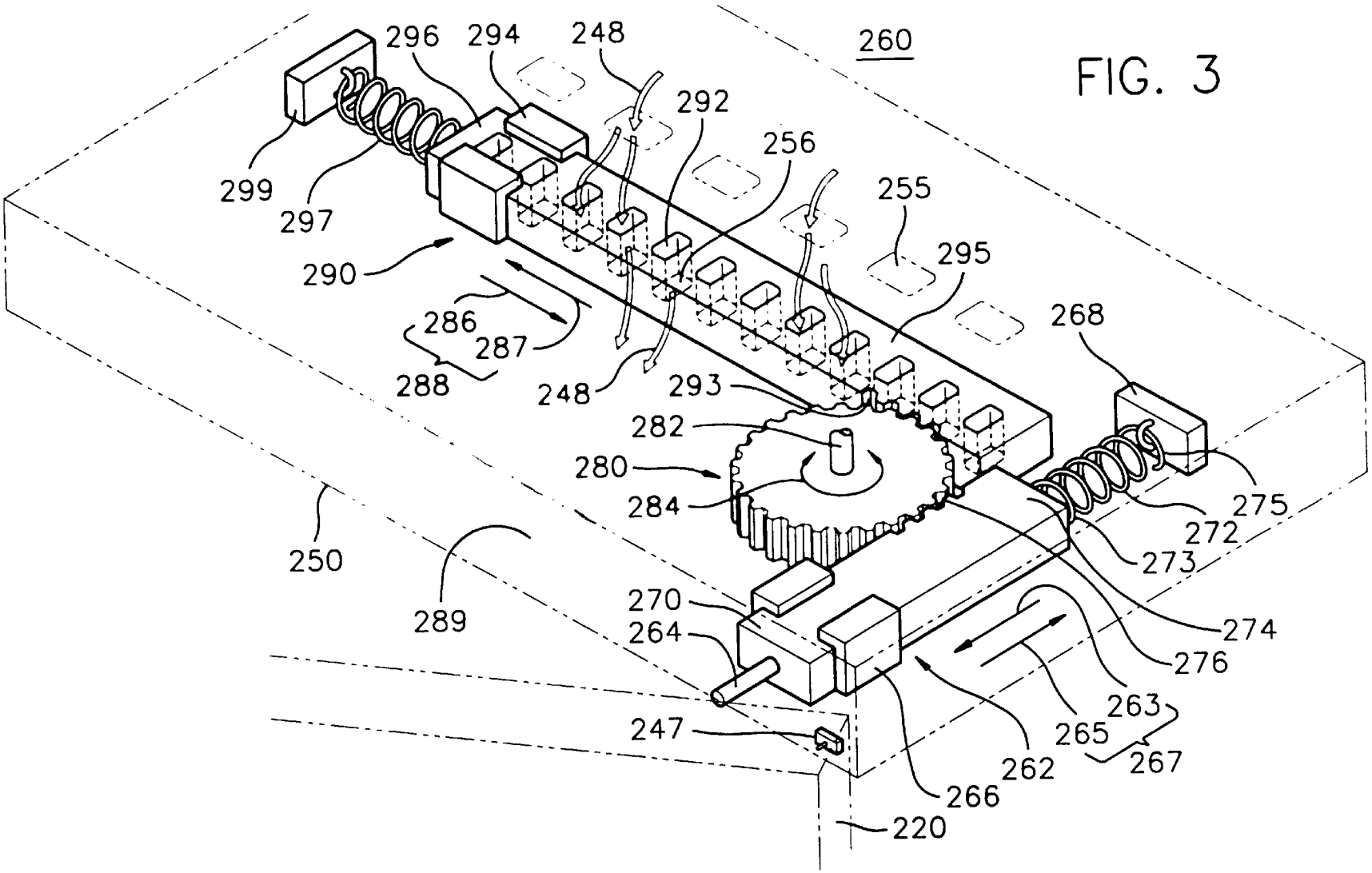
FIG. 3 is a perspective view showing the apparatus provided in the compartment of the refrigerator for preventing the air from flowing into the refrigerator.
Figure 4:
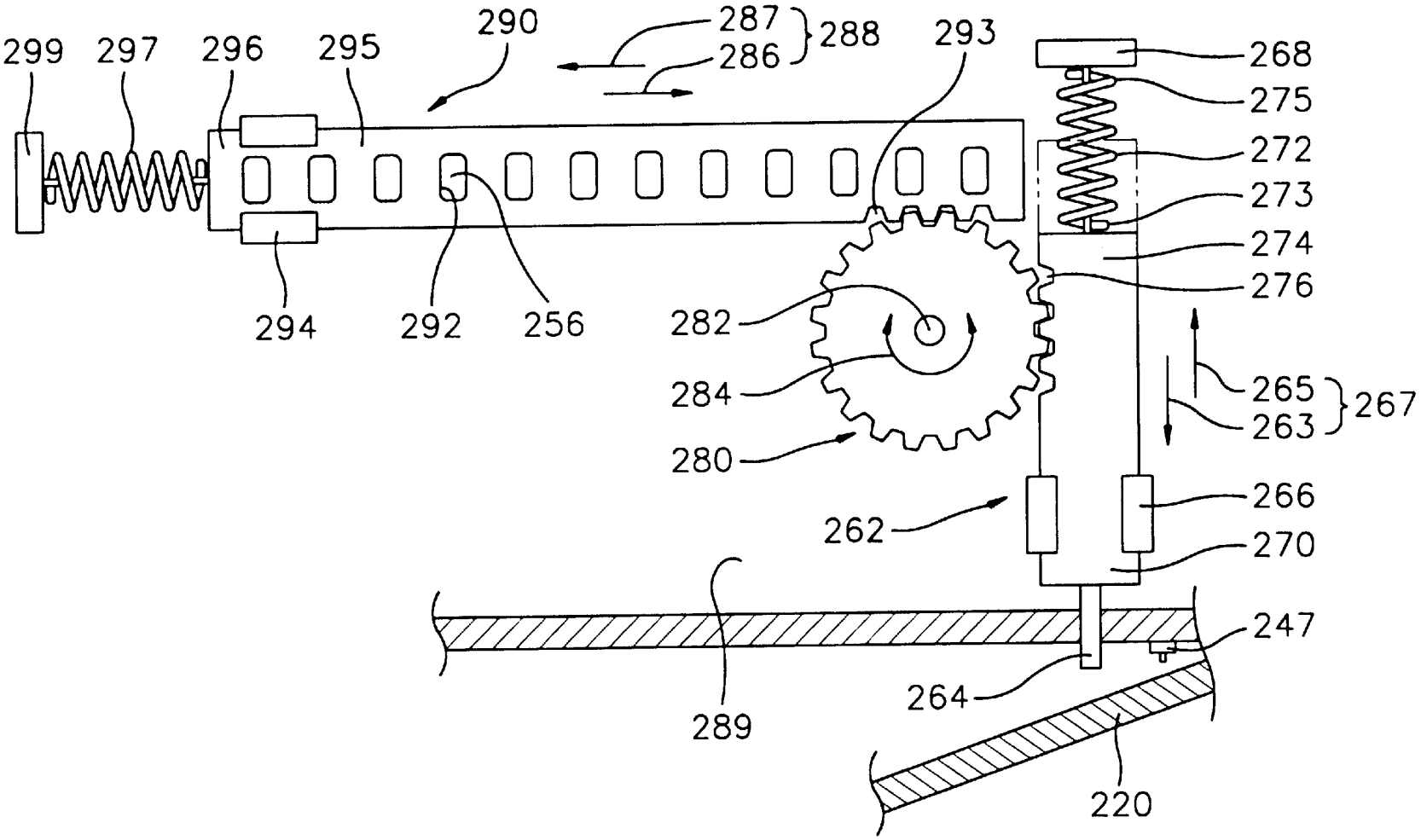
FIG. 4 is a plan view showing the apparatus for preventing the air from flowing into the refrigerator according to one embodiment of the present invention.

FIG. 3 is a perspective view showing the apparatus provided in the compartment of the refrigerator for preventing the air from flowing into the refrigerator, and FIG. 4 is a plan view showing the apparatus for preventing the air from flowing into the refrigerator according to one embodiment of the present invention.

As illustrated, the apparatus 260 for preventing the air from flowing into the refrigerator is mounted at the inner portion of the compartment 250, and is placed adjacent to a hinge of the refrigerator door 220.

The apparatus 260 for preventing the air from flowing into the refrigerator includes a first lever 262 which reciprocates in an arrow direction 267 while the door 220 of the refrigerating chamber 240 is being opened/closed, a circular gear 280 engaged with the first lever 262 and which rotates in an arrow direction 284 while the first lever 262 is being reciprocated, and a second lever 290 engaged with the circular gear 280 and which reciprocates in the arrow direction 288 while the circular gear 280 rotates thereby opening/closing the first plurality of holes 256.

The first lever 262 is formed at a first end portion 270 thereof with a projection 264 for making contact with the door 220 of the refrigerating chamber 240. A first compressed spring 272 is connected to a second end portion 274 opposite to the first end portion 270 of the first lever 262. The first compressed spring 272 has first end portions 273 connected to a second end portion 274 of the first lever 262, and has a second end portion 275 connected to a first supporting bracket 268 spaced apart from the second end portion 274 of the first lever 262 by a predetermined distance in a rear direction so that the first compressed spring 272 elastically exerts the first lever 262 in the arrow direction 263.

Moreover, the first lever 262 is formed at one side thereof with a first rack gear 276 engaged with the circular gear 280.

A first guide member 266 for guiding the first lever 262 is installed adjacent to the first end portion 270 of the first lever 262 while the first lever 262 is being reciprocated. The first guide member 266 has a L-shape, and is fixed to an inner-lower surface of the compartment 250, and supports the first lever 262 from both sides.

When the door 220 of the refrigerating chamber 240 is closed, the first lever 262 is pushed by the door 220 of the refrigerating chamber 240 so that the first lever 262 moves in the arrow direction 265. Therefore, the first compressed spring 272 is compressed by the door 220 of the refrigerating chamber 240. When the door 220 of the refrigerating chamber 240 is opened, the first lever 262 moves in the arrow direction by an elastic force of the first compressed spring 272.

The circular gear 280 is rotatably fixed to a shaft 282 upwardly protruded from the inner-lower surface 289 of the compartment 250. While the first lever 262 is reciprocated in the arrow direction 267, the circular gear 280 rotates in a clockwise direction or a counterclockwise direction.

The second lever 290 is vertically placed with respect to the first lever 262, and the second lever 290 reciprocates in the arrow direction 288 by means of a rotation of the circular gear 280. The second lever 290 is formed at a body 295 thereof with a second plurality of holes 292 which has a same number and shape with the first plurality of holes 256 of the compartment 250.

The second lever 290 is formed at one side thereof with a second rack gear 293 engaging the circular gear 280. A second supporting bracket 299 is protrudingly formed spaced apart from a first end portion 296 of the second lever 290 by a predetermined distance in a rear direction. The second compressed spring 297 elastically exerts the second lever 290 in the arrow direction 286. A second guide member 294 for guiding the second lever 290 is installed adjacent to the first end portion 296 of the second lever 290 while the second lever 290 is being reciprocated. The second guide member 294 has a L-shape, is fixed to an inner-lower surface 289 of the compartment 250, and supports the second lever 290 from both sides.

The switch 247 is attached to the body 210 (FIG. 2) which is adjacent to the door 220 of the refrigerating chamber 240 (FIG. 2), and is of an "On/Off" type. The switch 247 transmits the electric power to the blower 215 (FIG. 2) while the door 220 is being opened so as to operate the blower 215 (FIG. 2). Also, the switch 247 closes the electric power transmitted to the blower 215 (FIG. 2) while the door 220 is being closed so as to stop the blower 215 (FIG. 2).

Hereinafter, the operation of the apparatus 260 for preventing the air from flowing into the refrigerator will be explained in more detailed in reference to FIGS. 2 and 3.

When the refrigerator door 220 is closed, the first lever 262 is pushed by the door 220 of the refrigerating chamber 240. And, the circular gear 280 engaged with the first lever 262 rotates at a predetermined angle in a counterclockwise direction so that the second lever 290 moves at the predetermined distance thereby closing the first plurality of holes 256 of the compartment 250. At this time, since the switch 247 is pushed by the door 220 of the refrigerating chamber 240, the switch 247 closes the electric power transmitted to the blower 215. Therefore, the operation of the blower 215 is stopped.

When the user opens the door 220 of the refrigerating chamber 220, the contact between the projection 264 of the first lever 262 and the refrigerator door 220 is released so that the first lever 262 moves in the arrow direction 263 by means of the elastic force of the first compressed spring 272.

At this time, the circular gear 280 engaged with the first lever 262 rotates in the clockwise direction so that the second lever 290 engaged with the circular gear 280 moves at the predetermined distance in the arrow direction 286. At this time, the second plurality of holes 292 formed at the body 295 of the second lever 290 communicates with the first plurality of holes 256 of the compartment 250. Accordingly, the cooled air is supplied to the refrigerating chamber 240 through the plurality of draining holes 207, the second plurality of holes 292, and the first plurality of holes 256.

Consequently, the cooled air is supplied in the arrow direction 248 so that the air curtain 245 is formed at the opening formed at a front side of the refrigerating chamber 240. Accordingly, when the refrigerator door 220 is opened, the air is prevented from flowing into the refrigerator by the air curtain 245.

On the other hand, the switch 247 transmits the electric power to the blower 215 while the refrigerator door 220 is being opened. Accordingly, the blower 215 strongly blows the cooled air in the freezing chamber 230 so that the cooled air circulates in the arrow direction 248 thereby forming the air curtain 255.

When the user closes the refrigerator door 220, the first lever 262 is again pushed by the refrigerator door 220 so that the first lever 262 moves in the arrow direction 265. Also, the circular gear 280 rotates in the counterclockwise direction, and the second lever 290 moves in the arrow direction 287. Accordingly, the first plurality of holes 256 of the compartment 250 is closed, and the supply of the cooled air is stopped. Accordingly, the air curtain 245 formed at the opening of the refrigerating chamber 240 is removed.

As explained through the embodiment, the apparatus for preventing the air from flowing into the refrigerator effectively prevents the air from flowing into the refrigerator by a simple structure.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A refrigerator comprising:

a refrigerator body;

a compartment for separating the refrigerator body into freezing and refrigerating chambers and having a plurality of draining holes horizontally disposed in a row at a front end portion of an upper surface thereof and having a first plurality of holes horizontally disposed in a row at a front end portion of a lower surface thereof for communicating with the plurality of draining holes thereby flowing a cooled air in the freezing chamber into the refrigerating chamber;

a means for allowing the cooled air in the freezing chamber to flow into the refrigerating chamber by opening the first plurality of holes when a door of the refrigerating chamber is opened thereby forming an air curtain in the refrigerating chamber, and for removing the air curtain by closing the first plurality of holes when the door of the refrigerating chamber is closed, the means including a first lever installed on an inner-lower surface of the compartment oriented with respect to a front end surface of the compartment so as to linearly reciprocate according to an opening/closing of the door of the refrigerating chamber, a second lever installed in a plane of the first lever for linearly reciprocating perpendicular to a moving direction of the first lever thereby opening/closing, the first plurality of holes, and a circular gear simultaneously engaged with the first and second levers for moving the second lever with respect to the moving direction of the first lever when the first lever is linearly moved;

a blower arranged at a rear portion of the freezing chamber for blowing the cooled air so as to circulate the cooled air in the freezing chamber into the refrigerating chamber; and a switch for transmitting an electric power to the blower thereby operating the blower when the door of the refrigerating chamber is opened, and for interrupting electric power transmission to the blower so as to stop an operation of the blower when the door of the refrigerating chamber is closed.

2. The refrigerator as claimed in claim 1, wherein the first lever has a first end portion in which a projection is protrudingly formed for making contact with a door of the refrigerating chamber, and has a second end portion opposite to the first end portion to which a compressed spring is connected.

3. The refrigerator as claimed in claim 2, wherein the compressed spring is elastically supported by a supporting bracket spaced apart from a second end portion of the first lever by a predetermined distance in a rear direction.

4. The refrigerator as claimed in claim 2, wherein the first lever is formed at one side thereof with a rack gear engaged with the circular gear.

5. The refrigerator as claimed in claim 2, wherein a guide member is fixed to an inner-lower surface of the compartment for guiding the first lever while the first lever is being reciprocated.

6. The refrigerator as claimed in claim 2, wherein the circular gear is rotatably fixed to a central shaft upwardly and protrudingly formed from the inner-lower surface of the compartment.

7. The refrigerator as claimed in claim 1, wherein the second lever is formed at a body thereof with a second plurality of holes, and the second plurality of holes thereof communicates with the first plurality of holes of the compartment while the second lever is being reciprocated.

8. The refrigerator as claimed in claim 7, wherein a compressed spring is disposed between a first end portion of the second lever and a supporting bracket formed at a rear portion of the first end portion of the second lever thereby elastically exerting the second lever.

9. The refrigerator as claimed in claim 7, wherein the second lever is formed at one side thereof with a rack gear engaged with the circular gear.

10. The refrigerator as claimed in claim 7, wherein a guide member is fixed to an inner-lower surface of the compartment for guiding the second lever while the second lever is being reciprocated.

11. The refrigerator as claimed in claim 1, wherein the switch is of an "On/Off" type.

* * * * *